US011028644B2

(12) United States Patent
Buckner

(10) Patent No.: US 11,028,644 B2
(45) Date of Patent: Jun. 8, 2021

(54) DRILL WITH A BOOM ARM AND A SELF-ALIGNING SUPPORT SYSTEM

(71) Applicant: Lynn Allan Buckner, Flintstone, GA (US)

(72) Inventor: Lynn Allan Buckner, Flintstone, GA (US)

( * ) Notice: Subject to any disclaimer, the term of this patent is extended or adjusted under 35 U.S.C. 154(b) by 121 days.

(21) Appl. No.: 16/501,407

(22) Filed: Apr. 6, 2019

(65) Prior Publication Data

US 2019/0309574 A1 Oct. 10, 2019

Related U.S. Application Data

(60) Provisional application No. 62/761,901, filed on Apr. 10, 2018.

(51) Int. Cl.
*E21B 7/02* (2006.01)
*E21B 12/00* (2006.01)

(52) U.S. Cl.
CPC ..... *E21B 7/024* (2013.01); *E21B 7/027* (2013.01); *E21B 7/028* (2013.01); *E21B 12/00* (2013.01)

(58) Field of Classification Search
CPC ..... E21B 7/024; E21B 7/028
See application file for complete search history.

(56) References Cited

U.S. PATENT DOCUMENTS

| | | | | | |
|---|---|---|---|---|---|
| 2,905,280 | A * | 9/1959 | Weaver | E21B 7/023 | 52/118 |
| 3,211,225 | A * | 10/1965 | Thiessen | E21B 41/02 | 166/90.1 |
| 3,977,636 | A * | 8/1976 | Bumueller | B62D 49/02 | 248/652 |
| 4,249,600 | A * | 2/1981 | Bailey | E21B 19/22 | 166/77.2 |
| 2009/0178853 | A1* | 7/2009 | Pavlik | E21B 12/06 | 175/84 |
| 2014/0251697 | A1* | 9/2014 | Jones | E21B 7/027 | 175/382 |
| 2018/0087338 | A1* | 3/2018 | Hau | E21B 25/10 | |
| 2018/0334856 | A1* | 11/2018 | Fontana | E21B 47/09 | |

* cited by examiner

*Primary Examiner* — Giovanna Wright

(57) ABSTRACT

A drill apparatus mounted to a vehicle; having a vehicle, a boom arm apparatus and a drilling apparatus, wherein a first end of the boom arm apparatus is attached to the vehicle and the drill apparatus is flex ably attached to a second end of the boom arm apparatus via a self aligning apparatus so that the drill apparatus is forced against a surface which is to be drilled via the boom arm apparatus, thus securing the stability of the drill apparatus against the drilling surface and the drill mast is self-aligned substantially perpendicular to the surface to be drilled.

18 Claims, 5 Drawing Sheets

DRILL WITH A BOOM ARM AND A SELF-ALIGNING SUPPORT SYSTEM

BACKGROUND OF THE INVENTION

Field of the Invention

The present invention relates to an articulated boom arm method and apparatus for moving a drill from a stored position to a ready to work position.

Description of the Prior Art

Current state of the art drilling apparatus consist of a powered motor and a drill bit mounted to a mast. The mast is mounted to a sturdy base. The drill is generally mounted to the mast via a carriage. The carriage can move the attached drill up and down the mast.

The apparatus described above is generally manually lifted from a storage position to a work position and then manually leveled in preparation to drill a hole.

The human operator generally stands on the mast base for the purpose of adding weight to the mast base in order to keep the drill bit from walking and moving horizontal while attempting to drill a vertical hole.

The above described drilling system is hazardous to the employees back and general body condition. Lifting the mass of steel or being thrown from the mast base during the drilling process are dangerous to the operator.

The above described drilling system is not a safe, convenient and efficient way for moving the drilling apparatus from a stored position to a ready to drill work position or for securing it during the drilling process.

State of the art large truck mounted core drilling and well drilling apparatus consist of a drill mounted to a mast via a carriage. The mast assembly uses the truck as it's base. At best the mast can tilt on the truck base.

It is an object of the present invention to provide a drill mounted to a mast via a carriage and the mast being mounted to a vehicle via a self aligning apparatus whereby the drill mast may be securely attached to the vehicle during transport and the drill mast can also be efficiently moved to a ready to drill position including self adjusting of the drill to the surface to be drilled without manually lifting the drill, carriage or the mast.

It is yet another object of the present invention for the boom arm in combination with the self-aligning apparatus to return the drill, carriage and mast to its original secure storage position on the vehicle.

It is yet another objective of the invention to provide added down pressure on the mast base during the drilling process for the purpose of keeping the drill bit such as a concrete core drill bit from walking or moving in respect to the desired new hole while tempting to drilling the hole.

It is yet another objective of the present invention to store a drilling liquid under pressure on the vehicle for cooling and or lubricating the drill bid during the drilling operation.

It is yet another objective of the present invention to provide a powered, efficient apparatus means for attaching and removing the drill, mast, and articulated boom arm to and from a vehicle.

It is yet another objective of the present invention to have the powered articulated boom arm serve as a robotic arm with the ability to position and hold a concrete core drill bit perpendicular to a desired surface to be drilled even if the desired surface to be drilled is an inclined surface or a vertical surface.

It is yet another objective of the invention to contain, collect and remove contaminants such a dust, solids and or liquids from the drilling process area; such as dust, grindings and water which are present at or near a concrete core drilling activity. A drill bit area containment apparatus in combination with a vacuum producing apparatus methods of containing, collecting and removing contaminants such a dust, solids and or liquids from the drilling process area.

It is yet another objective of the invention to collect data which is relevant and or associated with the drilling operation to include but not be limited to data associated with drill speed, bit rotations, bit pressure, contaminant production, contaminant concentrations, RFID for identifying who is the operator, GPS for locating the place that the hole was drilled, GIS for positioning a hole in respect to a utility and real time transmitting of the data to other interested parties, such as to a cell phone.

SUMMARY OF THE INVENTION

The shortcomings and disadvantages of the prior art are overcome by the current invention.

The above described objectives and others are met by a method comprising a device which mounts a drill to a mast via a carriage and the mast and mast base is mounted to a vehicle via a compressible apparatus and an articulated boom arm whereby the drill mast may be securely attached to the vehicle during transport and the drill mast can also be efficiently moved to a ready to drill position including self leveling to the drill surface without manually lifting the drill, carriage, mast or mast base.

The boom may comprise one or more arms for moving the mast base, mast, carriage and drill in a position substantially perpendicular to a surface which is to be drilled. A vertical lift apparatus such as a hydraulic cylinder, air cylinder, linear actuator or the likes may be used for moving the mast up and down in a vertical direction. The boom arm may also include a powered knuckle joint so that the boom arm apparatus functions as a robotic arm.

A self-aligning apparatus such as a ball & socket, compression apparatus or the like may be attached between the mast and the boom arm for the purpose of allowing the mast to position its self substantially perpendicular to the surface to be drilled when the boom arm movement apparatus presses the mast base against the surface to be drilled.

The compression apparatus may comprise a wire compression spring, an air spring, an air bag, a rubber cushion or the like.

The compression apparatus in combination with the boom arm further accomplishes the task of adding weight and or pressure to the mast base during the drilling process thus securing the stability and location of the drill bit during the drilling activity.

A griping apparatus may be attached to the mast base for the purpose of securing the location of the drill bid during the drilling activity.

The gripping apparatus may include suction, rubber, abrasive substances or the like.

Prominent features of the present invention have been broadly outlined above in order that the detailed description that follows may be understood. There are additional features of the invention that will be described hereinafter and which will form the subject matter of the claims appended hereto.

A vacuum producing apparatus in combination with a containment apparatus will contain, collect, store and remove contaminants from the drill bit operation.

DETAILED DESCRIPTION OF THE PREFERRED EMBODIMENTS

Using the drawings, illustrations of the present invention will now be explained.

Figure 1:
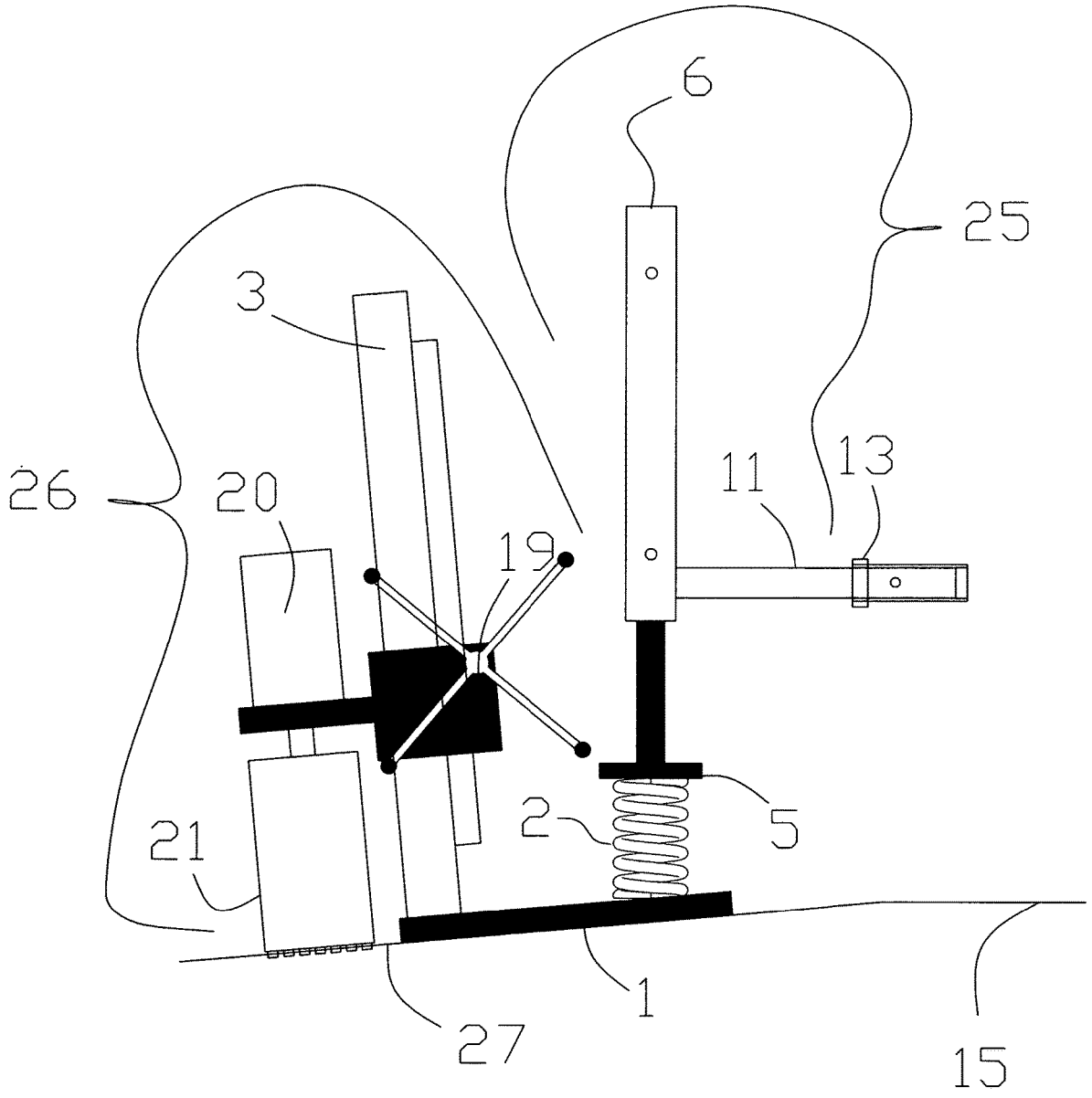
FIG. 1 Is a side elevation view illustrating a drill apparatus mounted to a vehicle. The drill apparatus is shown to include a drill, a carriage, a mast and a mast base. A vehicle shown to attach to a first end of a boom arm and a second end of the boom arm is shown to be a vertically mounted hydraulic or air cylinder. (a linear actuator could be used instead of the cylinder) The rod end of the cylinder is considered to be the second end of the boom arm. A wire compression spring is shown as an example for a compressible apparatus for attaching the second end of the boom to the drilling apparatus. The wire compression spring is shown to allow the hydraulic cylinder rod to force the drill apparatus against a surface which is to be drilled thus securing the stability of the drill apparatus against the drilling surface. The wire compression spring also compensated for slope and elevation differences between the vehicle and the surface to be drilled.
Figure 5:
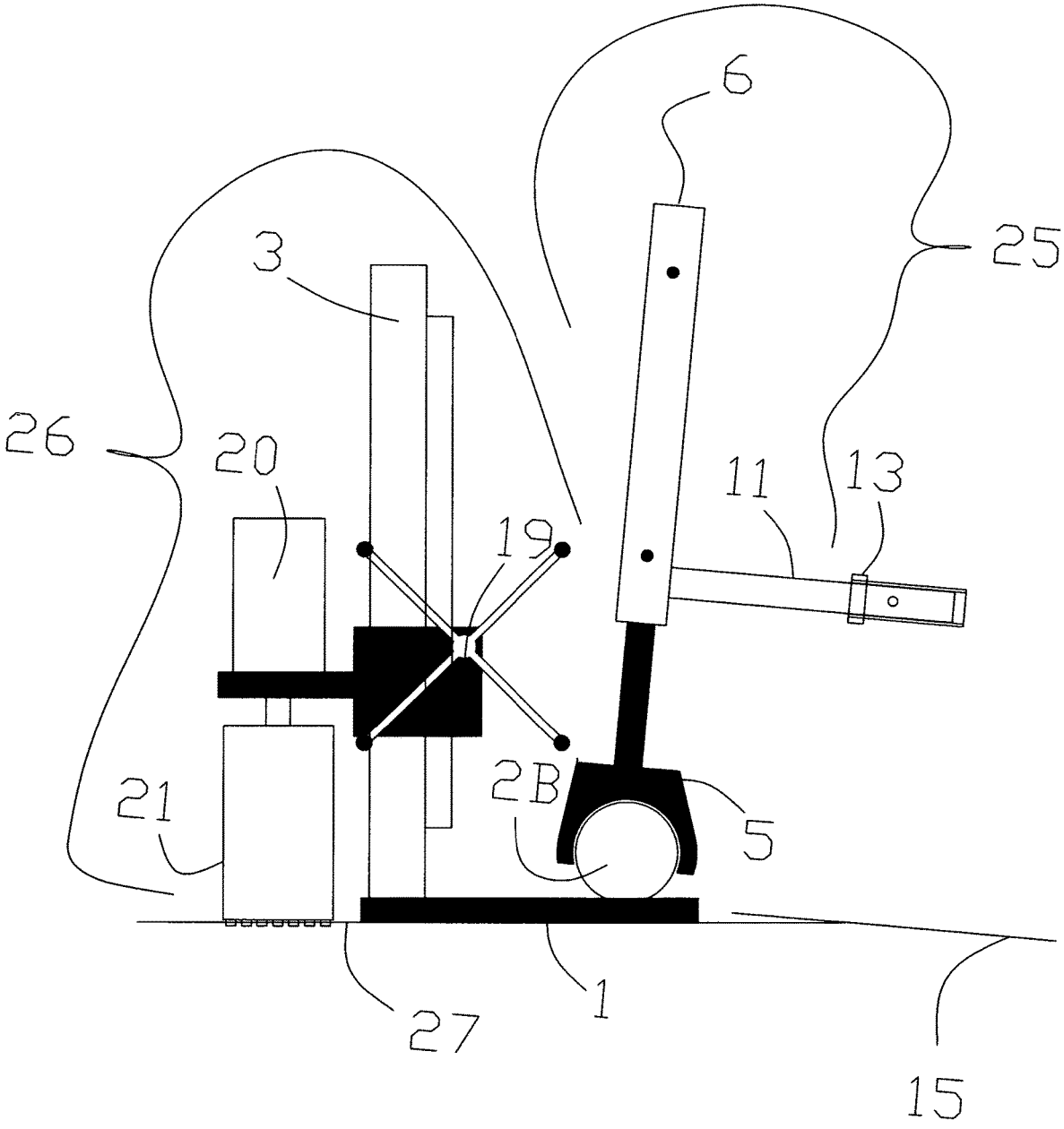
FIG. 5 is a side elevation view similar to FIG. 1 but in this example a ball and socket are used for assisting in the self-aligning of the drill to the drill surface.

FIG. 1 Is a side elevation view illustrating a drill apparatus 26 mounted to a vehicle receiver 13. The drill apparatus 26 is shown to include a drill 20, (Drill: a powered motor with a shaft that is adapted to attach and rotate a bit.) a carriage 19, a mast 3 and a mast base 1. A drill bit 21 (Bit: a small piece, part, or quantity of something.) may be attached to the drill 20. The drill bit 21 may be a concrete core drill bit 21, an auger bit 21, a screw bit 21, a socket 21 for loosening or tightening a nut or bolt, a utility valve key 21 for opening or closing a valve, or the like. The drill 20 may be chosen from an electric powered drill 20, an air powered drill 20, a hydraulic powered drill 20 or the like. A vehicle receiver 13 for a hitch 11 is shown to receive and attach to a first end of a boom arm apparatus 25 (Boom Arm: An arm used to support an apparatus). Although the hitch 11 is illustrated as a quick coupler to a quick receiver 13; the hitch 11 may be chosen from multiple other methods of attaching and or bolting a boom arm to a vehicle. The first end of the boom arm apparatus 25 is shown to be a hitch 11 and a second end of the boom arm apparatus 25 is shown to be a telescoping cylinder 6 which has been mounted vertically (a telescoping cylinder 6 may be hydraulic cylinder, an air cylinder, a linear actuator or the like.) The rod end or second end 5 of the telescoping cylinder 6 is considered to be the second end of the boom arm apparatus 25. The boom arm apparatus 25 is illustrated to include a hitch 11, a telescoping cylinder 6 and a rod end 5. A self-aligning apparatus 2 is illustrated as a compression spring 2 and is shown as an example for a self-aligning apparatus 2 for attaching the second end 5 of the boom arm apparatus 25 to the drilling apparatus 26. In FIG. 5 the self-aligning apparatus 2 is illustrated as a ball and socket 2B. The rod end 5 of the cylinder 6 forces the drill apparatus 26 against a surface 27 which is to be drilled thus securing the stability of the drill apparatus 26 against the drilling surface 27. The self-aligning apparatus 2 transmits force from the cylinder 6 to the drill apparatus 26. The self-aligning apparatus 2 compensates for slope differences between the vehicle and the surface 26 to be drilled. (The self-aligning apparatus 2 can be chosen from a wire spring, an air spring, an air bag, a rubber bladder, a compressible rubber, a ball and socket or the like.)

Figure 2:
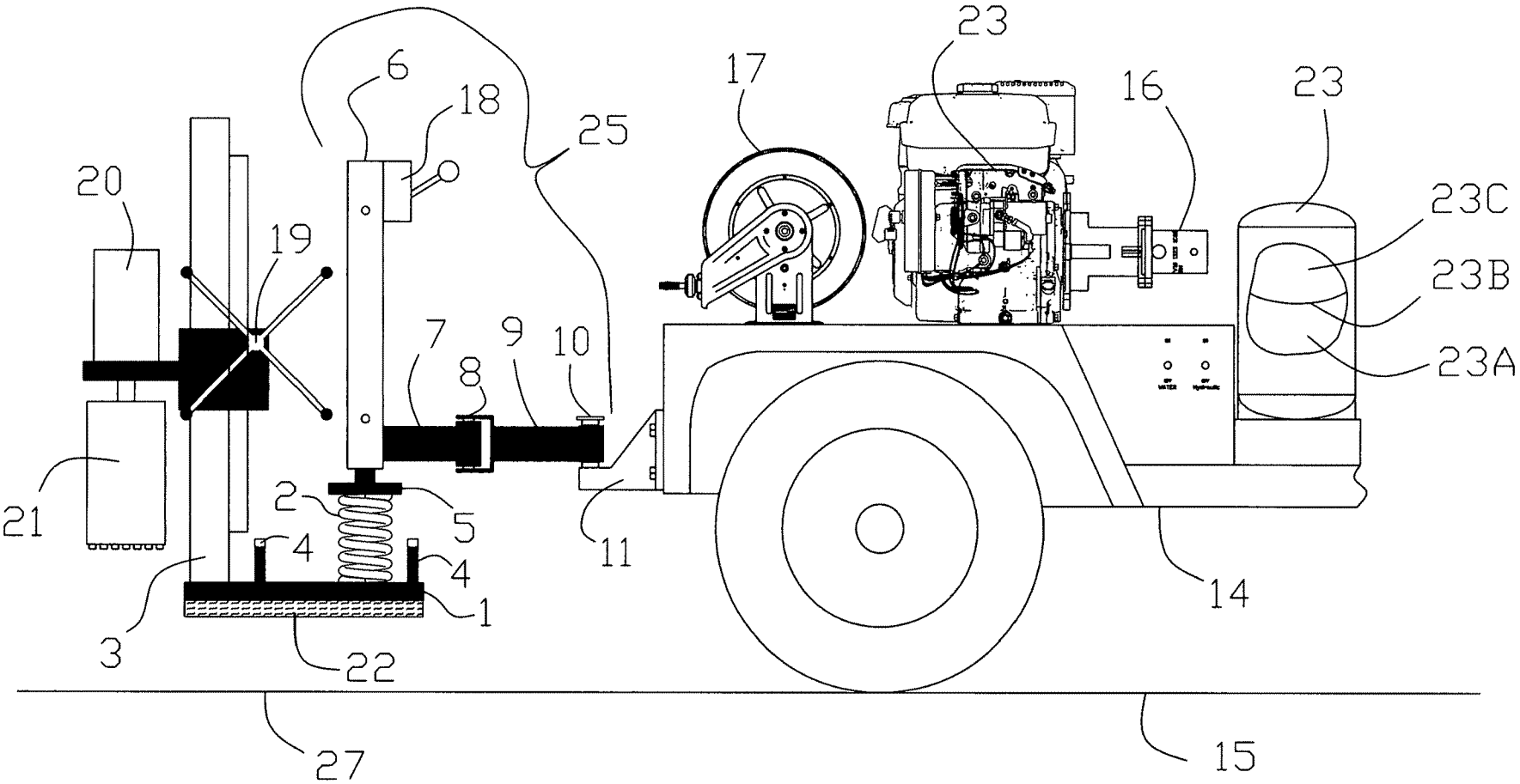
FIG. 2 is a side elevation view of a drill mounted to a mast via a carriage and the mast being mounted to a vehicle via a compressible apparatus in combination with an articulated boom arm and a trailer receiver hitch. The vehicle is a trailer with a motor powering an energy source for operating the drill. A bladder tank is shown to be storing a drill liquid under pressure. The drill mast base is shown to be in a retracted position located part way between a stored position and a drilling position.

FIG. 2 shows a side view of a boom arm apparatus 25 in which the boom arm apparatus 25 further includes the added feature of being an articulated boom arm. (Articulated: having two or more arms connected by a rotate able joint) The articulated boom arm 25 includes arms 7 & 9 and rotate able joints 8 & 10. Mast base 1 is shown to have a gripping pad 22 attached to its under side for the purpose of reducing movement between the mast base 1 and the drilling surface 27. The gripping pad 22 can be an abrasive sand paper like substance, a rubber, a suction cup, a vacuum apparatus or the like. Leveling screws 4 are shown for the purpose of adjusting the orientation of the mast base 1 to the drilling surface 27. Controls 18 may include all control functions required for operating the drilling apparatus 26 and the boom arm apparatus 25.

Boom arm 25 uses hitch 11 for bolting the boom arm 25 to vehicle 14. (Vehicle: an apparatus used for transporting people or goods, especially on land, such as a car, truck, trailer or cart.) The vehicle 14 is illustrated as further including a motor 23, for powering an energy supply source 16 which can be chosen from a hydraulic pump 16, an air compressor 16, an electric generator 16 or the like 16. A Reel 17 is illustrated as a means for transporting energy from the energy supply source 16 to the boom arm apparatus 25 and or the drilling apparatus 26. A bladder tank 23 is illustrated as a method of storing and supplying a drill cooling and or lubrication liquid 23A to the concrete core drill bit 21. Air 23C is compressed within tank 23 as drill liquid 23A is added to the bladder tank 23. A diaphragm 23B separates air 23C from drill liquid 23A. Drill liquid 23A is stored under pressure via the compressed air 23C which is stored on the other side of diaphragm 23B.

FIG. 2 illustrates drilling apparatus 26 lifted from the drilling surface 27 via the boom arm apparatus 25. The boom arm apparatus 25 can then move the drilling apparatus 26 to a secure & latched transport position near the hitch 11.

Figure 3:
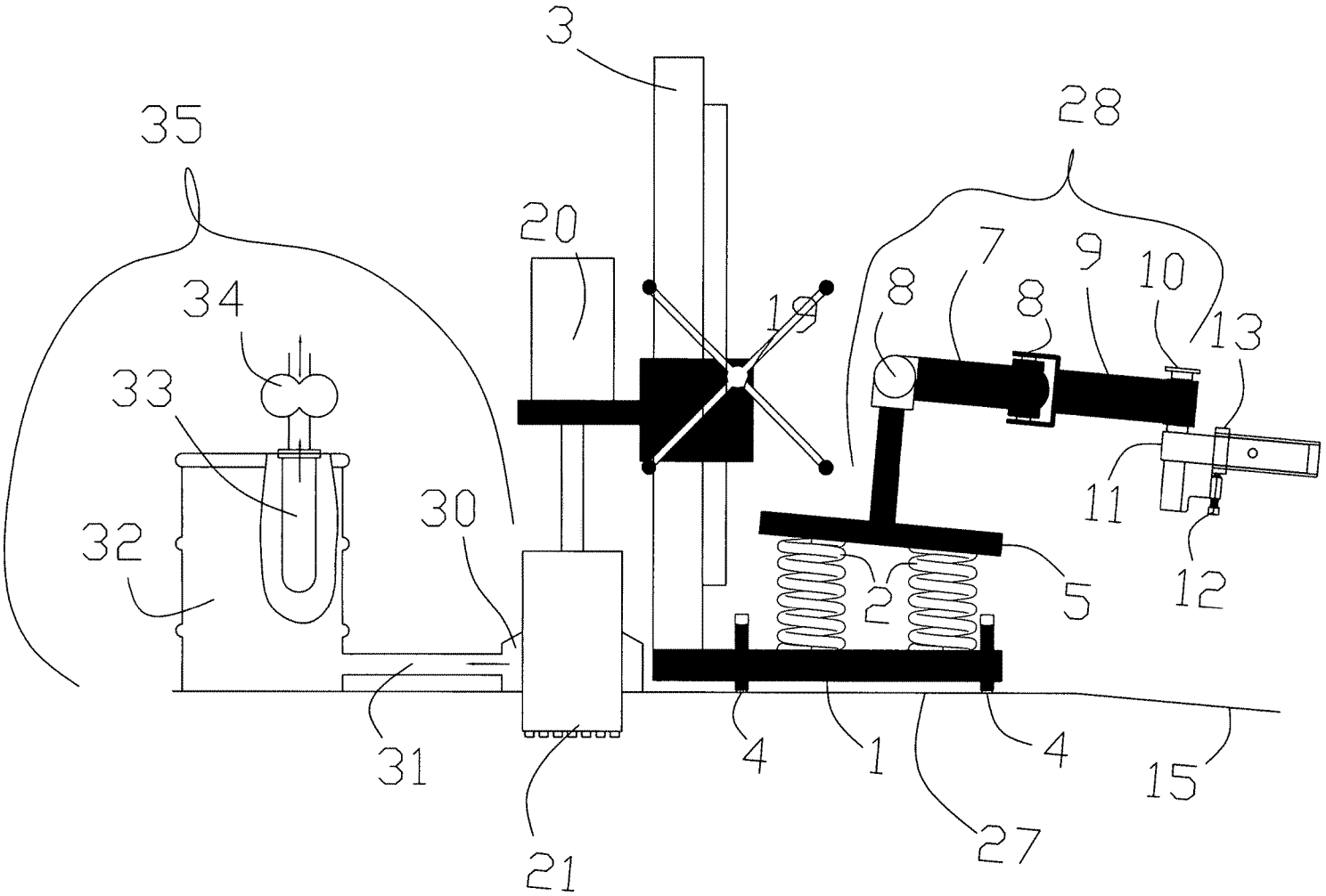
FIG. 3 is a side elevation view similar to FIG. 2 but in this example multiple compression springs are used and a robotic articulated boom arm is used. A vacuum producing apparatus is shown for capturing dust, solids & liquid which are present during the concrete core drilling process.

FIG. 3 illustrates a powered robotic articulated boom arm 28 as another example of a boom arm apparatus 25. Set screw 12 is shown attached to hitch 11 for the purpose of securing and stabilizing hitch 11 to receiver 13. The second end of the powered robotic articulated boom arm 28 is shown attached to the drilling apparatus 26 via multiple compression apparatus 2. Dust, solids, and liquids present during the concrete sawing process are captured by the vacuum recovery apparatus 35. The dust, solids and liquids contaminants which are present near the core drill bit 21 are contained within the core drill contaminants housing 30. A hose or conduit 31 conveys the contaminants to a vacuum container 32 via a vacuum producing apparatus 34. A filter 33 may be used for keeping the contaminants in the vacuum container 32.

Figure 4:
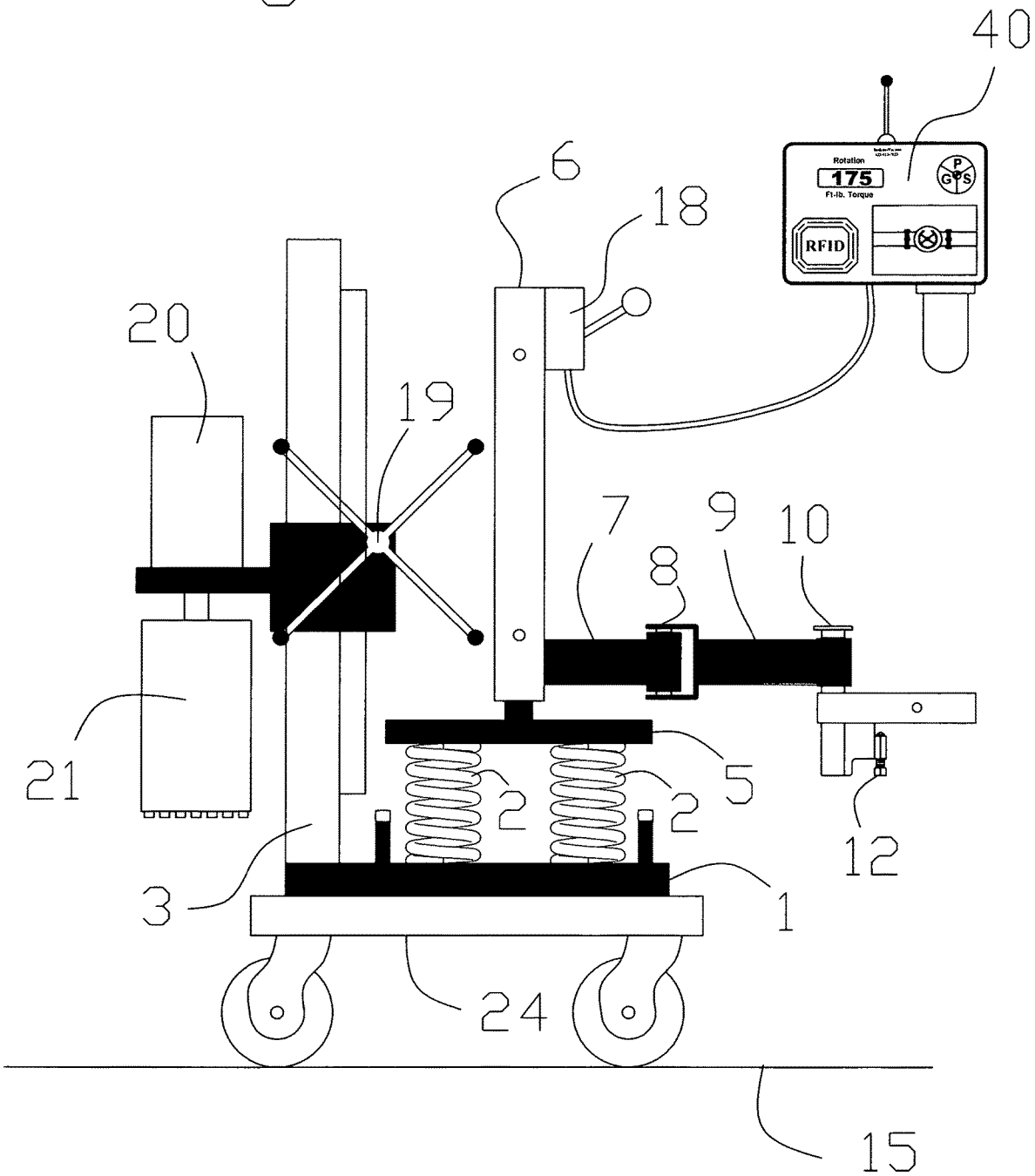
FIG. 4 is a side elevation view illustrating the drill apparatus stored on a dolly. The drill apparatus used the hydraulic cylinder to raise or lower the drill apparatus to an equilibrium so that the drill apparatus along with the boom arm apparatus could be easily removed from a vehicle receiver hitch. An electronic data management and data collection, storage and transmitting system is also illustrated.

FIG. 4 illustrates the drill apparatus 26 and the boom arm apparatus 25 positioned on a dolly 24 detached from the vehicle receiver 13. By using the controls 18 and the cylinder 6 the drilling apparatus 26 can be lowered onto the dolly 24 and an equilibrium can be established between hitch 11 and receiver 13. Once receiver 13 is removed from hitch 11 the controls 18 in combination with cylinder 6 can lower the boom arm apparatus 25 thus establishing as stable secure transportable method for storing the complete drilling apparatus 26 with its boom arm apparatus 25. FIG. 4 also illustrates a process control and data collection, storage and transmitting apparatus 40. System 40 may include RFID, GPS, graphic GIS data display and system performance data gathering & transmitting. Data collection, storage and transmitting apparatus 40 will accomplish the collection of data which is relevant and or associated with the drilling operation to include but not be limited to data associated with drill speed, bit rotations, bit pressure, contaminant production, contaminant concentrations, RFID for identifying who is the operator, GPS for locating the place that the hole was drilled, GIS for positioning a hole in respect to a utility and real time transmitting of the data to other interested parties, such as to a cell phone.

FIG. 5 is similar to FIG. 1 except that a ball & socket 2B are illustrated as the means for self alignment of the concrete core drill apparatus 26 in respect to the surface to be drilled 27.

The preceding description has been presented only to illustrate and describe an example of the invention. It is not intended to be exhaustive or to limit the invention to any precise form disclosed. Many modifications and variations are possible in light of the above teaching.

The illustrations were chosen and described in order to explain the principles of the invention and its practical application. The preceding description is intended to enable others skilled in the art to utilize the invention in various embodiments and with various modifications as are suited to the particular use contemplated. It is intended that the scope of the invention be defined by the following claims.

If, for any reason this application is not believed to be in full condition for allowance, applicant respectfully request the constructive assistance and suggestions of the Examiner pursuant to M.P.E.P. 2173.02 and 707.07(j) in order that the undersigned can place this application in allowable condition as soon as possible and without the need for further proceedings.

The invention claimed is:

1. A self aligning core drilling apparatus for mounting to a vehicle, comprising: a boom arm apparatus having two or more arms wherein said boom arm apparatus further comprises a rotate able joint for attaching said arms one to the other; a vehicle mounting apparatus for attaching said boom arm apparatus to a vehicle; and further comprising a telescoping apparatus, a self-aligning apparatus and a core drill apparatus, wherein a first end of said boom arm apparatus is attached to said vehicle via said vehicle mounting apparatus; and a first end of said telescoping apparatus is attached to a second end of said boom arm apparatus, and a second end of said telescoping apparatus is attached to a first end of said self-aligning apparatus; and a second end of said self-aligning apparatus is attached to said core drill apparatus; whereby said core drill apparatus may be positioned substantially perpendicular to a surface when said telescoping apparatus presses said self-aligning apparatus against said surface.

2. The apparatus as described in claim 1 wherein said self-aligning apparatus further comprises screws for adjusting the orientation of said self-aligning apparatus in respect to a surface that said self-aligning apparatus is resting on.

3. The apparatus as described in claim 1 wherein said core drill apparatus further comprises a mast apparatus, a carriage apparatus, a motor mount apparatus, a motor apparatus, and a core drill bit attachment apparatus, wherein a first end of said mast apparatus is attached to a second end of said self-aligning apparatus and said carriage apparatus is attached to said mast apparatus in such a way as to allow said carriage to be moved along a length of said mast apparatus and said motor apparatus is attached to said carriage apparatus via said motor mount apparatus and said core drill bit attachment apparatus is attached to said motor apparatus; whereby a core drill bit may be attached to said motor apparatus via said core drill bit attachment apparatus and said core drill bit may be used to core a hole in and perpendicular to a surface which supports said self-aligning apparatus.

4. The apparatus as described in claim 1 wherein said vehicle further comprises a power source for powering said core drill apparatus.

5. The apparatus as described in claim 1 wherein said vehicle further comprises a water storage apparatus and said water storage apparatus further comprises a water pumping apparatus for supplying water to said core drill apparatus.

6. The apparatus as described in claim 1 wherein said boom arm apparatus is configured to move said core drill apparatus from a stored position to a position for drilling a predetermined hole in a predetermined surface.

7. The apparatus as described in claim 1 and further comprising a dolly apparatus for removing said self-leveling core drilling apparatus from said vehicle for the purpose of storage until said self leveling core drilling apparatus once again needs to be reattached to said vehicle.

8. The apparatus as described in claim 1 wherein said vehicle is a trailer apparatus and said trailer apparatus further comprises a power supply for powering said core drill apparatus, a water storage and supply apparatus for furnishing cooling and lubrication water to said core drill apparatus.

9. The apparatus as described in claim 1 wherein said vehicle is a trailer apparatus and said trailer apparatus further comprises a power supply for powering said core drill apparatus, a water storage and supply apparatus for furnishing cooling or lubrication water to said core drill apparatus and further comprising storage compartments for tools and supplies needed during or for a core drilling operation.

10. The apparatus as described in claim 1 and further comprising data gathering, data logging and storage of information related to a core drilling operation; whereby data may be stored and/or transmitted.

11. The apparatus as described in claim 1, wherein said boom arm apparatus further comprises powered arms for articulating the direction or length of said powered arms, whereby said articulated boom arm apparatus can move and hold said core drill apparatus in any one of three axes.

12. The apparatus as described in claim 1 and further comprising a vacuum system apparatus for recovering liquid and solids which are related to a core drilling operation.

13. The apparatus as described in claim 1 and further comprising auxiliary tools, wherein said auxiliary tools are chosen from a pile driver, a jack hammer, a water pump, a post driver, a post puller, a drill or a saw apparatus.

14. The apparatus as described in claim 1 wherein said boom arm apparatus is a robotic arm.

15. The apparatus as described in claim 1 wherein said self-aligning apparatus further comprises a ball and socket apparatus.

16. The apparatus as described in claim 1 wherein said self-aligning apparatus further comprises one or more compression springs.

17. A self aligning drilling apparatus for mounting to a vehicle, comprising: a boom arm apparatus having two or more arms wherein said boom arm apparatus further comprises a rotate able joint for attaching said arms one to the other; a vehicle mounting apparatus for attaching said boom arm apparatus to a vehicle; and further comprising a telescoping apparatus, a self-aligning apparatus and a drill apparatus, wherein a first end of said boom arm apparatus is attached to said vehicle via said vehicle mounting apparatus; and a first end of said telescoping apparatus is attached to a second end of said boom arm apparatus, and a second end of said telescoping apparatus is attached to a first end of said self-aligning apparatus; and a second end of said self-aligning apparatus is attached to said drill apparatus, wherein said drill apparatus is positioned substantially perpendicular to a surface when said telescoping apparatus presses said self-aligning apparatus against said surface.

18. A self aligning core drilling apparatus for mounting to a vehicle, comprising: a boom arm apparatus having two or more arms wherein said boom arm apparatus further comprises a rotate able joint for attaching said arms one to the other; a vehicle mounting apparatus for attaching said boom arm apparatus to a vehicle; and further comprising a telescoping apparatus, a self-aligning apparatus and a core drill apparatus, wherein a first end of said boom arm apparatus is attached to said vehicle via said vehicle mounting apparatus; and a first end of said telescoping apparatus is attached to a second end of said boom arm apparatus, and a second end of said telescoping apparatus is attached to a first end of said self-aligning apparatus; and a second end of said self-aligning apparatus is attached to said core drill apparatus, wherein said core drill apparatus further comprises a mast apparatus, a carriage apparatus, a motor mount apparatus, a motor apparatus, and a drill bit attachment apparatus, wherein a first end of said mast apparatus is attached to a second end of said self-aligning apparatus and said carriage apparatus is attached to said mast apparatus so as to allow said carriage apparatus to be moved along a length of said mast apparatus and said motor apparatus is attached to said carriage apparatus via said motor mount apparatus and said drill bit attachment apparatus is attached to said motor apparatus; wherein a drill bit is attached to said motor apparatus via said drill bit attachment apparatus and said drill bit is used for core drilling a hole in and substantially perpendicular to a surface which supports said self-aligning apparatus when said self-aligning apparatus is forced against said surface via said telescoping apparatus.

* * * * *